US008113645B2

(12) United States Patent
Koyanagi

(10) Patent No.: US 8,113,645 B2
(45) Date of Patent: Feb. 14, 2012

(54) RECORDING APPARATUS

(75) Inventor: Noriyuki Koyanagi, Kitakyushu (JP)

(73) Assignee: Seiko Corporation, Tokyo (JP)

( * ) Notice: Subject to any disclaimer, the term of this patent is extended or adjusted under 35 U.S.C. 154(b) by 431 days.

(21) Appl. No.: 12/270,524

(22) Filed: Nov. 13, 2008

(65) Prior Publication Data

US 2009/0121412 A1 May 14, 2009

(30) Foreign Application Priority Data

Nov. 14, 2007 (JP) ..... 2007-295999
Oct. 6, 2008 (JP) ..... 2008-259487

(51) Int. Cl.
*B41J 2/01* (2006.01)
*B41J 27/26* (2006.01)
*B65H 1/00* (2006.01)

(52) U.S. Cl. ..... 347/104; 271/171; 400/54

(58) Field of Classification Search ..... 347/2–5, 347/16, 19, 9, 104; 399/401; 271/227, 171; 400/54

See application file for complete search history.

(56) References Cited

U.S. PATENT DOCUMENTS 4,705,412 A * 11/1987 Matsumoto ..... 400/54
7,134,657 B2 * 11/2006 Yanagi et al. ..... 271/171

FOREIGN PATENT DOCUMENTS

| | | |
|---|---|---|
| JP | 2002-128286 | 5/2002 |
| JP | 2005-010349 | 1/2005 |
| JP | 2005-256395 | 9/2005 |
| JP | 2007-223789 | 9/2007 |

* cited by examiner

*Primary Examiner* — Lam S Nguyen
(74) *Attorney, Agent, or Firm* — Workman Nydegger

(57) ABSTRACT

A recording apparatus includes: a loading section in which a recording medium is set; a feed roller feeding the recording medium set in the loading section; a first urging mechanism urging one of the loading section and the feed roller to decrease a distance between the set recording medium and the feed roller; an edge guide being movable in a width direction of the recording medium to align lateral edges of the recording medium set in the loading section; a DC motor allowing the edge guide to move; and a determination unit determining whether a current value at the time of driving the DC motor reaches a predetermined threshold value. Here, the driving of the DC motor is stopped when it is determined by the determination unit that the current value reaches the predetermined threshold value.

7 Claims, 13 Drawing Sheets

RECORDING APPARATUS

BACKGROUND

1. Technical Field

The present invention relates to a recording apparatus having a loading section in which a recording medium is set, a feed roller feeding the recording medium, an urging mechanism urging one of the loading section and the feed roller to decrease a distance between the set recording medium and the feed roller, and an edge guide being movable in a width direction of the recording medium to align lateral edges of the recording medium set in the loading section.

In the invention, examples of the recording apparatus include an ink jet printer, a wire dot printer, a laser printer, a line printer, a copier, and a facsimile.

2. Related Art

In the past, as described in JP-A-2002-128286, a recording apparatus included a feed roller feeding a sheet and a hopper which is movable close to and apart from the feed roller and in which sheets are placed. A pair of edge guides guiding the width direction of the sheets was disposed in the hopper to be slidable in the width direction. Accordingly, when a user sets sheets, the user should broaden the edge guides in the width direction and then place the sheets on the hopper. Then, the user should allow the edge guides to slide toward each other, thereby aligning both lateral edges of the sheets. As a result, the sheets could be fed in a state where the posture of the sheets is stabilized.

However, the user should manually allow the edge guides to slide to a predetermined position. Accordingly, the posture of the sheets in feed might be inclined without the user's manual operation. Both lateral edges of the sheets stacked on the hopper might not be aligned. In this case, the positions of the sheets in the width direction might not be matched with each other, thereby causing a mismatch in recording positions of the sheets. As a result, the recording operation might not be performed well.

SUMMARY

An advantage of some aspects of the invention is that it provides a recording apparatus that can satisfactorily align both lateral edges of recording mediums and stabilize postures of the recording mediums.

According to an aspect of the invention, there is provided a recording apparatus including: a loading section into which a recording medium is set; a feed roller feeding the recording medium set in the loading section; a first urging mechanism urging one of the loading section and the feed roller to decrease a distance between the set recording medium and the feed roller; an edge guide being movable in a width direction of the recording medium to align lateral edges of the recording medium set in the loading section; a DC motor allowing the edge guide to move; and a determination unit determining whether a current value at the time of driving the DC motor reaches a predetermined threshold value. Here, the driving of the DC motor is stopped when it is determined by the determination unit that the current value reaches the predetermined threshold value.

Here, the "DC motor" means a so-called "brush-attached DC motor" or "brushless motor" using a DC power source and does not include a "stepping motor" driven in proportion to the number of input pulses.

According to the above-mentioned configuration, the recording apparatus includes the edge guide, the DC motor, and the determination unit determining whether the current value at the time of driving the DC motor reaches the predetermined threshold value, and stops the driving of the DC motor when the determination unit determines that the current value reaches the predetermined threshold value.

Here, the "predetermined threshold value" is a value greater than the current value when the recording medium with the lateral edge not aligned is pressed in an alignment direction in the course of movement of the edge guide and smaller than the current value when the edge guide comes in contact with the lateral edge of the recording medium with the lateral edge aligned.

Therefore, by allowing the edge guide to move by the use of the DC motor and determining whether the current value reaches the predetermined threshold value, it can be determined whether the edge guide has aligned the lateral edge of the recording medium.

Specifically, when the current value does not reach the predetermined threshold value, it can be determined that both lateral edges of the recording mediums are not aligned. Then, the DC motor can be further driven to press the edge guide against the lateral edges of the recording mediums.

On the other hand, when the current value reaches the predetermined threshold value, it can be determined that the edge guide comes in contact with the lateral edges of the recording mediums with the lateral edges aligned. Then, the DC motor can be stopped.

As a result, it is possible to stabilize the postures of the recording mediums. When plural recording mediums are set, it is possible to align both lateral edges of the recording mediums.

The recording apparatus may further include a recording medium size detector including a linear scale disposed in one of the loading section and the edge guide and a sensor disposed in the other to detect the linear scale.

According to this configuration, in addition to the above-mentioned operational advantage, the recording apparatus further includes a sheet size detector including a linear scale disposed in one of the loading section and the edge guide and a sensor disposed in the other to detect the linear scale. Accordingly, the recording medium size detector can detect the position of the edge guide when the DC motor is stopped. As a result, the recording medium size detector can detect the size of the recording medium set in the loading section with high precision.

The recording apparatus may further include a vibration generating mechanism causing the loading section to vibrate when the edge guide moves.

According to this configuration, the recording apparatus further includes a vibration generating mechanism causing the loading section to vibrate when the edge guide moves. Accordingly, it is possible to generate a gap between a recording medium and a recording medium being set in the loading section and overlapping with each other. That is, the gap can be generated when the recording mediums are closely attached, thereby easily aligning the lateral edges of the recording mediums. As a result, it is possible to align the lateral edges of the recording mediums with high precision.

It is possible to detect the recording medium size with high precision by the use of the sheet size detector.

For example, cutting surfaces of the recording mediums which are ends of the recording mediums may be closely attached to each other when a bundle of new recording mediums is set in the loading section. In this case, the gap can be generated to facilitate the alignment and the bundle of recording mediums can be undone to facilitate the separation at the time of feeding the recording mediums. Specifically, only the uppermost recording medium relative to the feed roller can be easily separated from the remaining recording mediums and can be fed. Accordingly, when a user sets a bundle of recording mediums, the user need not undo the bundle of recording mediums in advance.

In the recording apparatus, the vibration generating mechanism may generate a vibration in a stacking direction of the recording medium.

According to this configuration, in addition to the above-mentioned operational advantage, the vibration generating mechanism generates a vibration in a stacking direction of the recording medium.

When the vibration generating mechanism generates the vibration in the width direction, the recording mediums overlapping with each other tend to move together. That is, the recording mediums may not move relative to each other. Accordingly, no gap may be generated between the recording mediums overlapping with each other.

Therefore, by generating the vibration in the stacking direction intersecting the width direction and the feed direction, the recording mediums overlapping with each other can be made to easily move relative to each other. Accordingly, compared with the case where the vibration in the width direction is generated, it is possible to satisfactorily generate a gap between the recording mediums overlapping with each other.

The above description is specifically explained as follows.

When the vibration in the stacking direction is generated, the recording mediums overlapping with each other can be bumped against each other to generate a slight gap between the recording mediums overlapping with each other. That is, the lower recording medium in the stacking direction acts to slightly tip up the upper recording medium, thereby generating a slight gap between the recording mediums. Accordingly, it is possible to satisfactorily release the state where the recording mediums are closely attached to each other.

When the vibration in the stacking direction is being generated, the upper recording medium and the lower recording medium are repeatedly bumped against each other, thereby continuously generating the slight gap. The frictional resistance between the recording mediums overlapping with each other can be reduced by the slight gap. As a result, it is possible to easily align the lateral edges of the recording mediums.

On the other hand, when the vibration in the width direction is generated, the lower recording medium does not act to tip up the upper recording medium. Accordingly, a gap is hardly generated between the recording mediums.

When the recording mediums overlapping with each other have a flexible sheet shape, the recording mediums are easily bent in the stacking direction, but are hardly bent in the width direction. Accordingly, when the vibration in the stacking direction is generated, the recording mediums can be slightly bent, thereby generating the slight gap between the recording mediums overlapping with each other.

On the other hand, when the vibration in the width direction is generated, the recording mediums are hardly bent and thus a gap is hardly generated between the recording mediums overlapping with each other.

In the recording medium, the vibration generating mechanism may include: a first uneven portion disposed in one of the loading section and the edge guide to have an uneven shape in the width direction; and a first convex portion disposed in the other to come in contact with the first uneven portion.

According to this configuration, in addition to the above-mentioned operational advantages, the vibration generating mechanism includes a first uneven portion disposed in one of the loading section and the edge guide to have an uneven shape in the width direction, and a first convex portion disposed in the other to come in contact with the first uneven portion. Accordingly, when the edge guide moves, the first convex portion goes over the first uneven portion while vibrating.

In the recording apparatus, the vibration generating mechanism may be an ink suction device cleaning a recording head disposed in the recording section by suction.

According to this configuration, in addition to the above-mentioned operational advantages, the vibration generating mechanism is an ink suction device cleaning a recording head disposed in the recording section by suction.

Here, the ink suction device generally includes a pump generating a negative pressure. The pump includes a rotating member. By making the rotating member eccentric, it is possible to easily generate a relative great vibration.

Accordingly, by operating the ink suction device, it is possible to gives the vibration to the recording mediums set in the loading section. That is, it is possible to generate a vibration without newly providing a convex portion and an uneven portion.

The recording apparatus may further include a hopper lever urging the loading section to the feed roller and a cam portion allowing the hopper lever to fluctuate and the vibration generating mechanism may include a second uneven portion disposed in the hopper lever and the cam portion to have an uneven shape in a rotation direction of the cam portion and a second convex portion disposed in the other to come in contact with the second uneven portion. Here, the second uneven portion and the second convex portion may be brought into contact with each other in a state where the set recording medium and the feed roller are separated from each other.

According to this configuration, the recording apparatus includes the second uneven portion and the second convex portion and brings the second uneven portion into contact with the second convex portion in the state where the recording mediums are separated apart from the feed roller. Accordingly, in the state where the recording mediums are separated apart from the feed roller, the second convex portion goes over the second uneven portion while vibrating. As a result, it is possible to give the vibration to the recording mediums set in the loading section. That is, in a state before the loading section approaches the feed roller, that is, in a hopper down state before hopper up, it is possible to align the lateral edges of the recording mediums.

In the recording medium, the loading section may be made to move further apart from the feed roller when the edge guide moves in a state where the set recording medium and the feed roller are separated from each other.

According to this configuration, in addition to the above-mentioned operational advantages, the loading section is made to move further apart from the feed roller when the edge guide moves in a state where the set recording medium and the feed roller are separated from each other. Accordingly, at the time of allowing the edge guide to move, it is possible to generate a gap between the recording mediums set in the loading section and overlapping with each other. As a result, it is possible to align the lateral edges of the recording mediums with high precision.

The recording apparatus may be configured to drive the DC motor so as to allow the edge guide to move close to the lateral edge of the recording medium, to stop the driving of the DC motor when the current value reaches the predetermined threshold value, and to repeat backward and forward rotations of the DC motor to bump the edge guide against the lateral edge of the recording medium several times.

According to this configuration, in addition to the above-mentioned operational advantages, the backward and forward rotations of the DC motor are repeated to bump the edge guide against the lateral edge of the recording medium several times. Accordingly, it is possible to align the lateral edges of the recording mediums with higher precision. That is, since the once contact and press of the edge guide with the lateral edges of the recording mediums may not be sufficient, the precision can be enhanced by several contacts. This is particularly effective when it is difficult to align the lateral edges of the recording mediums due to materials of the recording mediums.

In the recording apparatus, the edge guide may include: an arm portion being movable in a stacking direction of the set recording medium; a spherical portion rotatably disposed at an end of the arm portion; and a second urging mechanism urging the arm portion to the recording medium.

According to this configuration, in addition to the above-mentioned advantages, the edge guide includes an arm portion being movable in a stacking direction of the set recording medium, a spherical portion rotatably disposed at an end of the arm portion, and a second urging mechanism urging the arm portion to the recording medium. Accordingly, it is possible to allow the edge guide to move while pressing the recording mediums set in the loading section. That is, when a relatively small number of recording mediums is set and the edge guide presses the lateral edges of the recording mediums, it is possible to prevent a so-called lifting deformation that a center portion in the width direction of the recording medium is lifted. As a result, even when the small number of recording mediums is set, it is possible to align the lateral edges of the recording mediums, like a large number of recording mediums.

Even when the small number of recording mediums is set, it is possible to detect the sheet size with high precision like a large number of recording mediums.

The spherical portion supported to be rotatable comes in contact with the recording medium. Accordingly, even when the spherical portion presses the recording medium, it does not prevent the recording medium from being fed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described with reference to the accompanying drawings.

Figure 1:
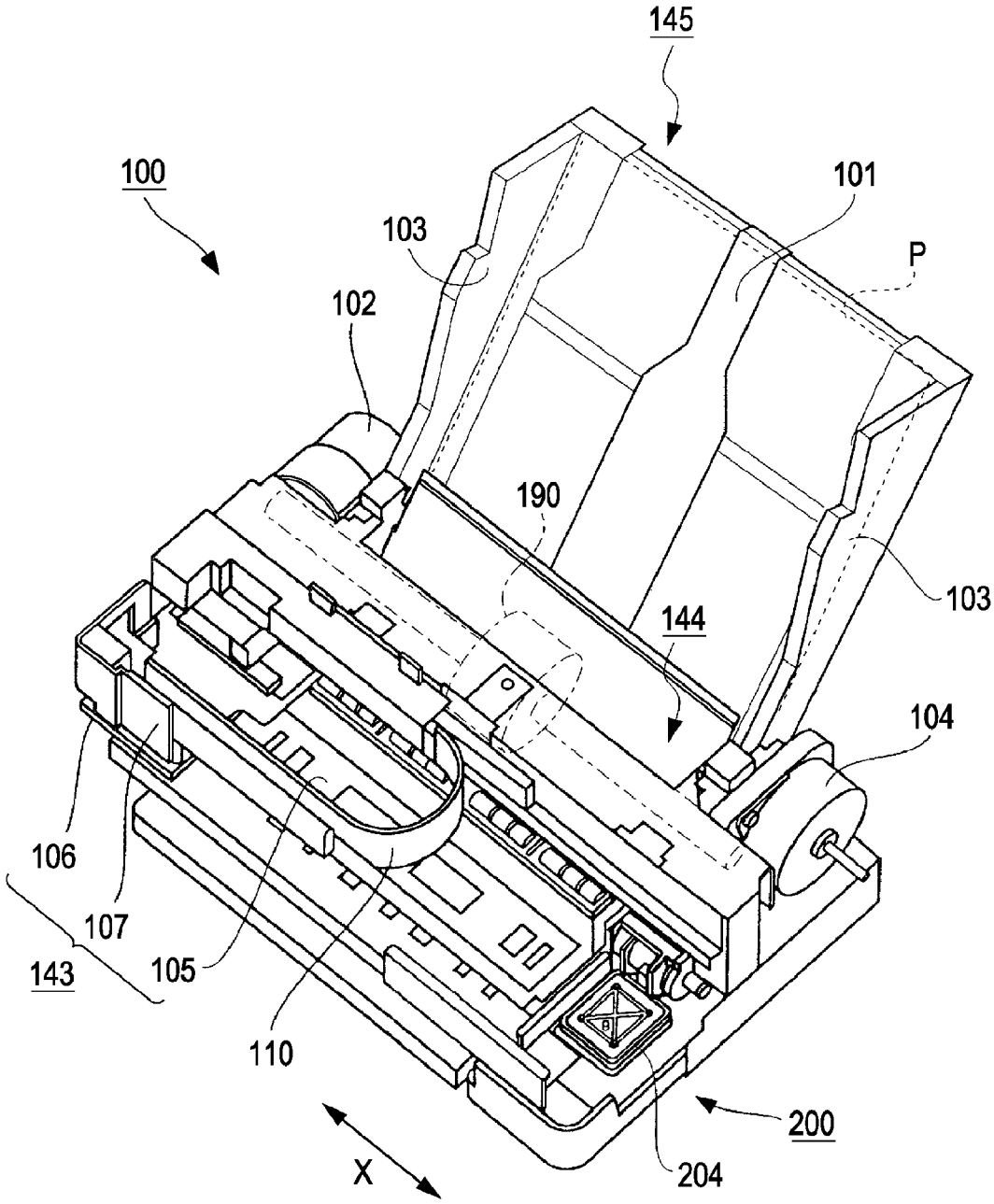
FIG. 1 is a perspective view schematically illustrating the entire configuration of a recording apparatus according to an embodiment of the invention.

FIG. 1 is a perspective view schematically illustrating the entire configuration of a recording apparatus as an example of a liquid ejecting apparatus according to an embodiment of the invention.

Here, examples of the liquid ejecting apparatus include an ink jet recording apparatus, a copier, and a facsimile performing a recording operation on a recording medium such as a sheet by ejecting ink to the recording medium from a recording head as a liquid ejecting head and apparatuses ejecting a liquid for particular use instead of the ink to an ejecting medium corresponding to the recording medium from a liquid ejecting head corresponding to the recording head and attaching the liquid to the ejecting medium in addition.

Examples of the liquid ejecting head include a coloring material ejecting head used to manufacture a color filter of a liquid crystal display and the like, an electrode material (conductive paste) ejecting head used to form an electrode of an organic EL display or a field emission display (FED), a biological organics ejecting head used to manufacturing a bio chip, and a sample ejecting head ejecting a sample as a precise pipette, in addition to the above-mentioned recording head.

A hopper 101 as a loading section 145 on which sheets P as the recording mediums are set and stacked is disposed on the rear side of the body of a recording apparatus 100 so as to be movable close to and apart from a feed roller 190 of a feeding section 144 described later. Specifically, the hopper is rotatable about a pair of hopper shafts 304 and 304 (see FIGS. 3 to 5) disposed above the hopper 101. The sheet P set at the uppermost position in the hopper 101 is fed toward a recording section which is downstream in a feeding direction by the feeding section 144.

Specifically, the set sheet P is fed to a transport roller pair 220 (see FIG. 2) downstream in the feeding direction by a feed roller 190 driven by a feeding motor 104 while being guided by right and left edge guides 103 and 103. The sheet P fed to the transport roller pair 220 is transported again to a recording section 143 located downstream in the transport direction by a transport driving roller 221 (see FIG. 2) of the transport roller pair 220 driving by a transport motor (not shown).

The recording section 143 includes a platen 105 supporting the sheet P from the downside and a carriage 107 disposed opposed to the platen 105 from the upside. The carriage 107 is guided by a carriage guide shaft (not shown) extending in a main scanning direction which is the width direction X of the transported sheet P and is driven by a carriage motor 102. A recording head 106 ejecting ink to the sheet P is disposed at the bottom of the carriage 107. The sheet P having been subjected to a recording operation by the recording section 143 is transported downstream and is discharged from the front surface of the recording apparatus 100 by a discharge roller (not shown).

An ink cartridge (not shown) is mounted into the lower portion of the recording apparatus 100 and ink is supplied to an ink supply path (not shown) through an ink supply needle (not shown). The ink is supplied to the recording head 106 of the carriage 107 through an ink supply tube 110. At the time of flushing and cleaning the recording head 106, the operation of ejecting and sucking the ink is performed in an ink suction device 200 as an ejection characteristic maintenance section disposed in one digit place to maintain an ejection characteristic of the recording section 143. The ink suction device 200 includes a cap portion 204 and is configured to move up and down the cap portion 204 to seal the recording head 106.

Figure 2:
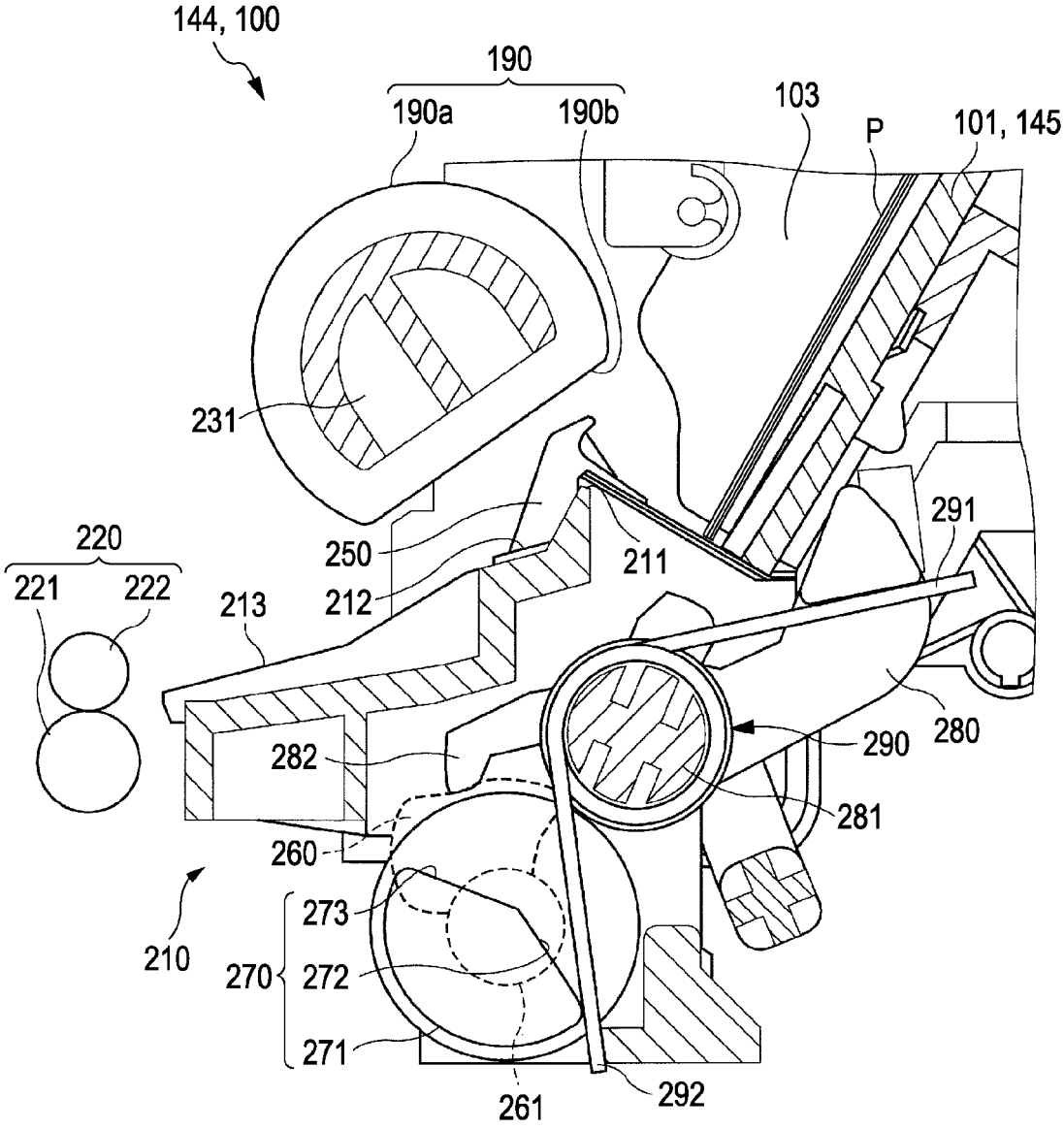
FIG. 2 is a side view schematically illustrating a feeding section according to the embodiment of the invention.

FIG. 2 is a side sectional view schematically illustrating a feeding section according to the embodiment of the invention.

As shown in FIG. 2, the feeding section 144 of the recording apparatus 100 includes a base portion 210, a fee roller 190, a hopper 101, and a hopper lever 280. The feed roller 190 is formed in a D shape as viewed from a feed roller shaft 231 and includes an arc portion 190*a* and a chord portion 190*b*. The hopper lever 280 is formed monolithic with a cam follower 282 to be rotatable about a lever shaft 281. A cam shaft 261 is provided with a hopper cam 260 and an urging force adjusting cam 270. The hopper cam 260 can engage with the cam follower 282. On the other hand, the urging force adjusting cam 270 is formed in a linear shape and includes a cam arc portion 271, a cam first linear portion 272, and a cam second linear portion 273.

A first arm portion 291 of a torsion coil spring 290 as an example of the urging mechanism engages with the hopper lever 280 and a second arm portion 292 comes in contact with the urging force adjusting cam 270.

The base portion 210 is provided with a clearance regulating portion 211 preliminarily separating a sheet P to be fed, a bank separation portion 212 as an example of the separation mechanism, and a guide surface portion 213 guiding the sheet P to the transport roller pair 220.

The bank separation portion 212 is a pad formed of a material having a high friction coefficient. The transport roller pair 220 includes a transport diving roller 221 driven with the power of the transport motor and a transport driven roller 222 rotating with the rotation of the transport driving roller 221.

The feeding section 144 includes a pair of return levers 250 and 250 returning the second uppermost and lower sheets P to the hopper 101 when the feed is finished, in the width direction X of the sheet P. The return levers 250 and 250 are configured to perform a returning operation with the power of the feeding motor 104.

When the hopper cam 260 rotates counterclockwise in FIG. 2 and engages with the cam follower 282, the hopper cam 260 rotates the hopper lever 280 clockwise against the urging force of the torsion coil spring 290. Accordingly, the hopper 101 moves apart from the feed roller 190, which is called hopper-down state.

When the hopper cam 260 rotates counterclockwise again and disengages from the cam follower 282, the hopper lever 280 rotates counterclockwise with the urging force of the torsion coil spring 290. Accordingly, the hopper 101 moves close to the feed roller 190, which is called hopper-up state.

In case of hopper up, the uppermost sheet P of the sheets P set in the hopper 101 is fed by the feed roller 190. Specifically, the uppermost sheet P is preliminarily separated from the second uppermost and lower sheets P by the clearance regulating portion 211 disposed in the base portion 210. When the feed roller 190 rotates again clockwise in FIG. 2, the leading end of the sheet P enters the bank separation portion 212 as the separation mechanism. In this embodiment, the bank separation portion 212 is a pad formed of an elastic material having a high friction coefficient as described above. Only the uppermost sheet P can go over the bank separation portion 212.

When the feed roller 190 rotates again, the leading end of the uppermost sheet P is guided by the guide surface portion 213 formed in the base portion 210 and reaches the transport roller pair 220. When the leading end of the sheet P reaches the transport roller pair 220, skew of the sheet P is removed by the transport roller pair 220 and the feed roller 190. The removal of skew may employ a "contact system" or a "biting and discharging system."

Here, the "contact system" means a system in which the leading end of the sheet P comes in contact with the stationary transport roller pair 220, the sheet P is bent between the feed roller 190 and the transport roller pair 220, and the posture of the leading end of the sheet P is made to comply with a nip line of the transport roller pair 220.

On the other hand, the "biting and discharging system" means a system in which the leading end of the sheet P is nipped by a predetermined amount by the transport roller pair 220 rotating forward, the transport roller pair 220 is made to rotate backward to bend the sheet P between the feed roller 190 and the transport roller pair 220, and the posture of the leading end of the sheet P is made to comply with the nip line of the transport roller pair 220.

After removing the skew, the sheet P is transported to the recording section 143 by the transport roller pair 220. At this time, the posture of the feed roller 190 is at a reset position.

Here, the "reset position" means a posture taken when the feeding is finished and means a phase where the chord portion 190*b* of the feed roller 190 is opposed to the clearance regulating portion 211 and the hopper 101.

A cork member as an example of the high frictional member is disposed at a position in the hopper 101 opposed to the feed roller 190 in the hopper-up state. Accordingly, a so-called avalanche phenomenon that the second uppermost and lower sheets P avalanches to the clearance regulating portion 211 can be reduced.

Figure 3:
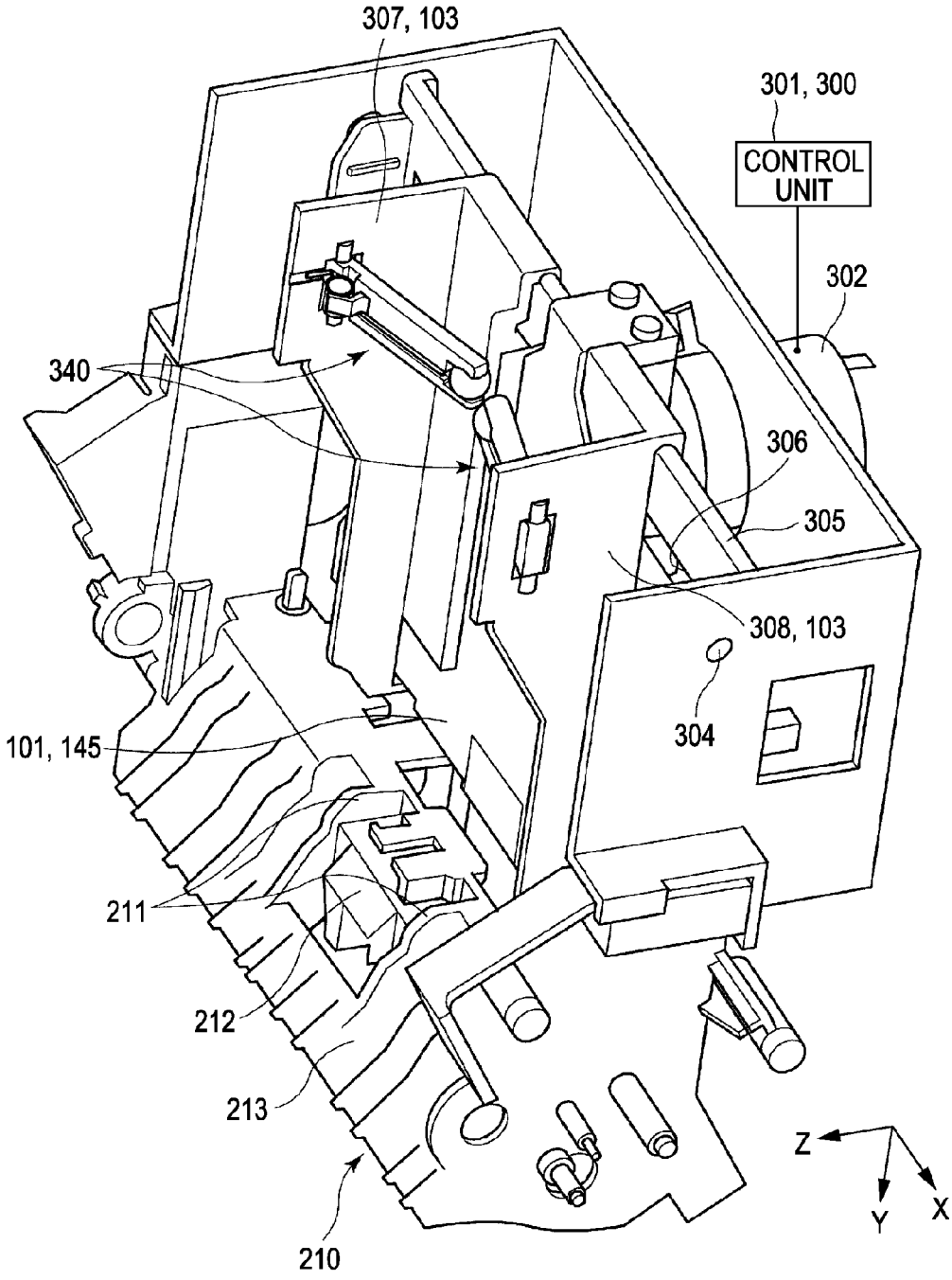
FIG. 3 is a perspective view schematically illustrating a loading section according to the embodiment of the invention.

FIG. 3 is a perspective view illustrating a loading section according to the embodiment of the invention.

As shown in FIG. 3, the hopper 101 is provided with the edge guides 103 and 103 slidable in the width direction X of the sheet P. Specifically, the hopper 101 is provided with a first guide rail portion 305 and a second guide rail portion 306 guiding the edge guides 103 and 103 in the width direction X of the sheet P. The edge guides 103 and 103 engage with the first guide rail portion 305 and are guided to be slidable in the width direction X.

The edge guides 103 and 103 include a right guide 307 and a left guide 308. The right guide 307 is disposed to guide the right end of the sheet P set in the hopper 101. On the other hand, the left guide 308 is disposed to guide the left end of the sheet P set in the hopper 101.

The right guide 307 and the left guide 308 slide to be symmetric about the center in the width direction X by a rack and pinion mechanism to be described later. The bottom of the hopper 101 is provided with a DC motor 302. The right guide 307 and the left guide 308 slide with the power of the DC motor 302. The recording apparatus 100 includes a determination unit 300 determining whether the current value at the time of driving the DC motor 302 reaches a predetermined threshold value. Specifically, a control unit 301 controlling the driving of the DC motor 302 serves as the determination unit 300. The "predetermined threshold value" is described later.

Pressing mechanisms 340 and 340 are disposed in the right guide 307 and the left guide 308, respectively. Although the detailed structure is described later, the pressing mechanisms 340 and 340 are configured to press the sheets P set in the hopper 101 from the upside to the downside in the stacking direction. Accordingly, the pressing mechanisms 340 and 340 can prevent the sheets P set in the hopper 101 from floating in the stacking direction Z.

Figure 4:
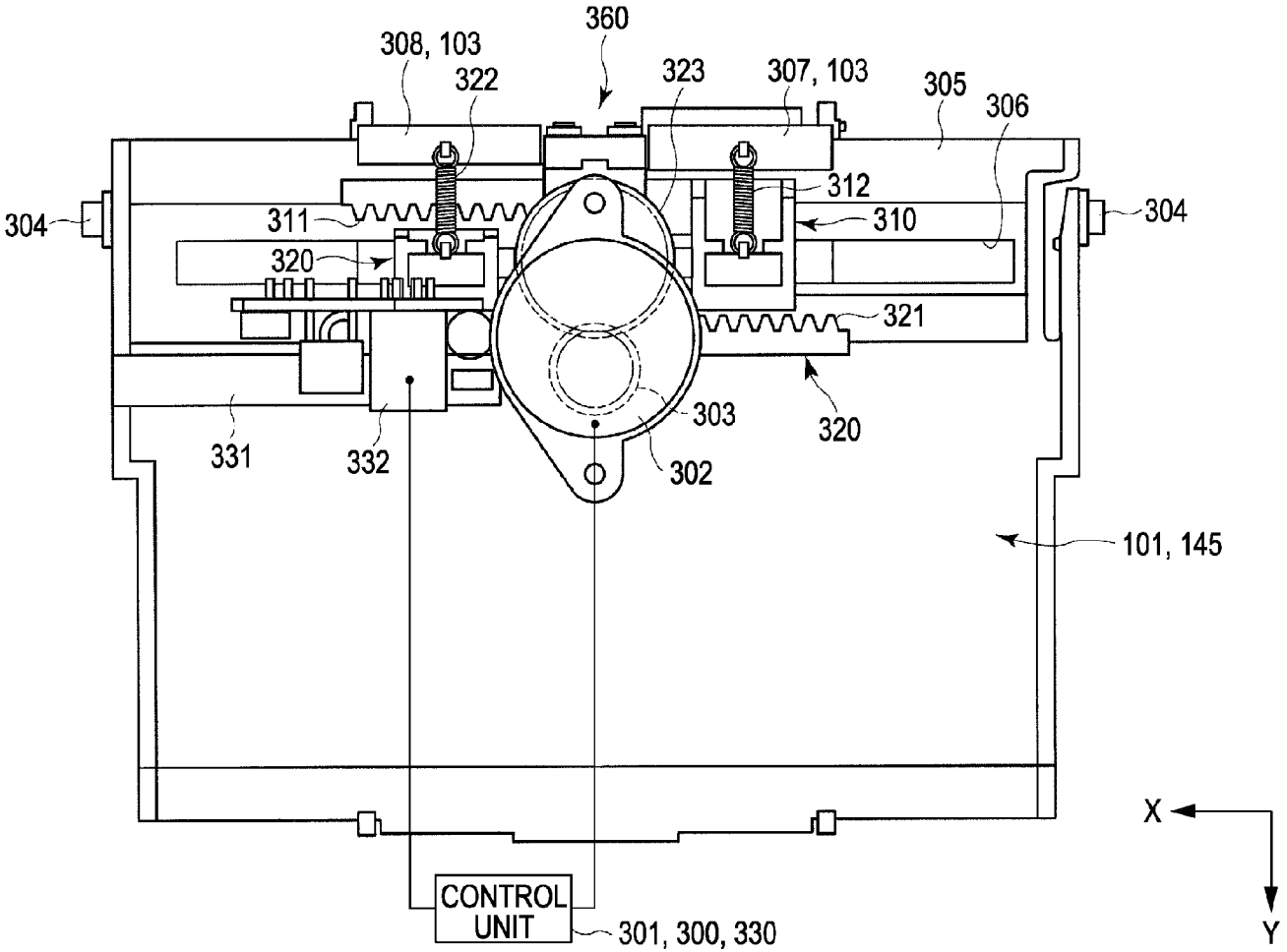
FIG. 4 is a bottom view schematically illustrating the loading section according to the embodiment of the invention.
Figure 5:
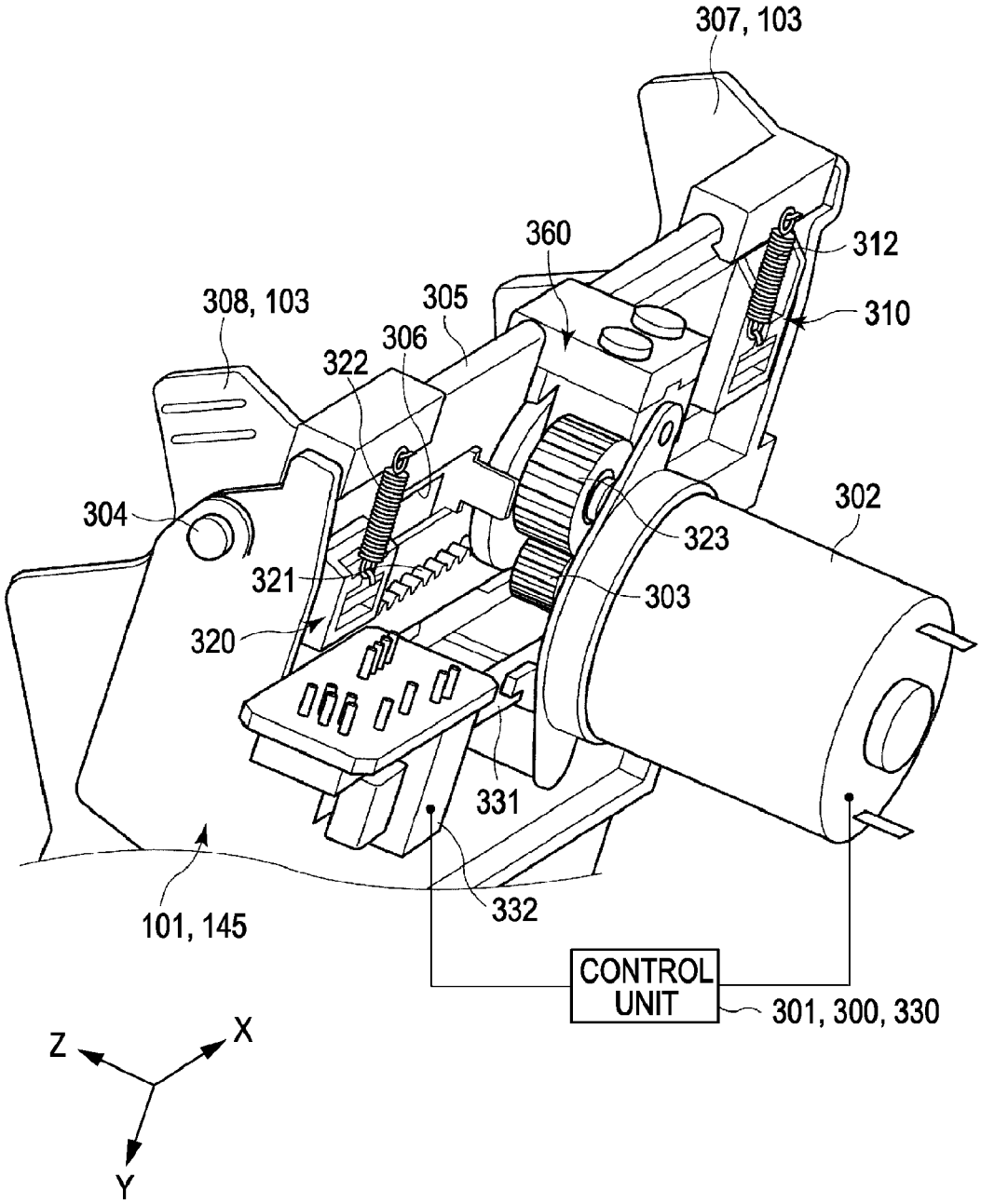
FIG. 5 is a side perspective view schematically illustrating the loading section according to the embodiment of the invention.
Figure 6:
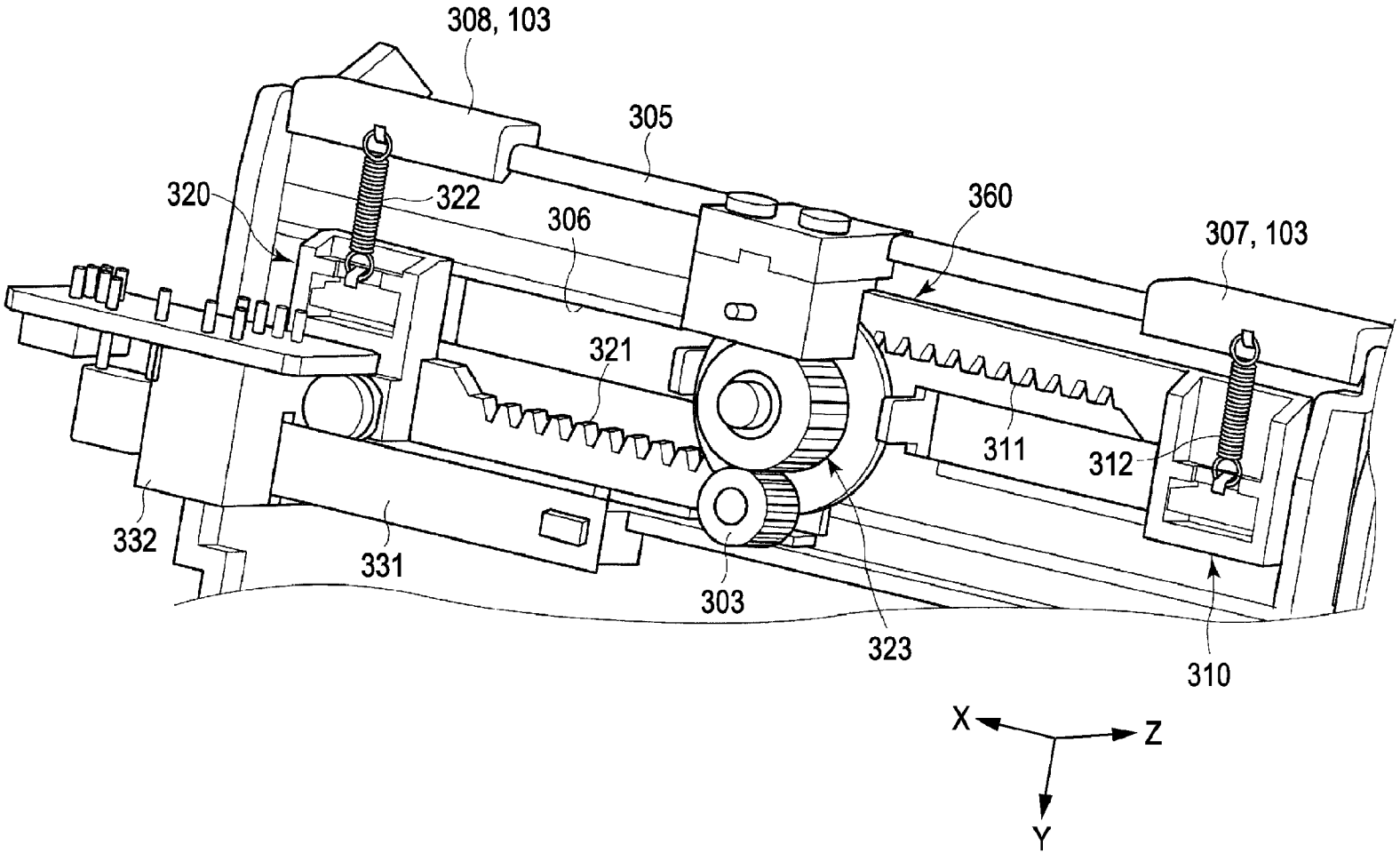
FIG. 6 is a rear perspective view schematically illustrating the loading section according to the embodiment of the invention.

FIG. 4 is a bottom view illustrating the loading section according to the embodiment of the invention. FIG. 5 is a side perspective view illustrating the loading section according to the embodiment of the invention. FIG. 6 is a rear perspective view of FIG. 5.

In FIG. 6, the DC motor is not shown for the purpose of easy understanding.

As shown in FIGS. 4 to 6, a link mechanism 360 as the rack and pinion mechanism making the movement of the right guide 307 and the movement of the left guide 308 symmetric is disposed in the bottom of the hopper 101. The link mechanism 360 includes a first rail engaging portion 310, a second rail engaging portion 320, and a complex pinion gear 323. The first rail engaging portion 310 engages with the right guide 307 to be movable in the Y axis direction as the feeding direction. The first rail engaging portion 310 comes in slidable contact with the second guide rail portion 306.

More specifically, one end of the first engagement spring 312 is locked to the right guide 307 and the other end is locked to the first rail engaging portion 310. Accordingly, the right guide 307 comes in slidable contact with the first guide rail portion 305 and the first rail engaging portion 310 comes in slidable contact with the second guide rail portion 306. Therefore, the position of the right guide 307 can be stabilized in the Y axis direction perpendicular to the X axis direction. The posture of the right guide 307 relative to the Y axis can be stabilized.

Similarly, the second rail engaging portion 320 engages with the left guide 308 to be movable in the Y axis direction. The second rail engaging portion 320 comes in slidable contact with the second guide rail portion 306.

More specifically, one end of the second engagement spring 322 is locked to the left guide 308 and the other end is locked to the second rail engaging portion 320. Accordingly, the left guide 308 comes in slidable contact with the first guide rail portion 305 and the second rail engaging portion 320 comes in slidable contact with the second guide rail portion 306. Therefore, the position of the left guide 308 can be stabilized in the Y axis direction perpendicular to the X axis direction. The posture of the left guide 308 relative to the Y axis can be stabilized.

The first rail engaging portion 310 includes a first rack portion 311 engaging with the complex pinion gear 323. Similarly, the second rail engaging portion 320 includes a second rack portion 321 engaging with the complex pinion gear 323. Accordingly, the movement of the right guide 307 and the movement of the left guide 308 can be made to be symmetric.

As described above, the postures of the first rail engaging portion 310 and the second rail engaging portion 320 can be stabilized by the first engagement spring 312 and the second engagement spring 322. The first rack portion 311 is formed monolithic with the first rail engaging portion 310. Similarly, the second rack portion 321 is formed monolithic with the second rail engaging portion 320. Accordingly, the postures of the first rack portion 311 and the second rack portion 321 can be stabilized. That is, the movement of the right guide 307 and the movement of the left guide 308 can be made to be symmetric with high precision.

The DC motor 302 is provided with a motor pinion 303. The motor pinion 303 is disposed to engage with the complex pinion gear 323. Accordingly, the right guide 307 and the left guide 308 can be made to move with the power of the DC motor 302.

The recording apparatus 100 further includes a sheet size detector 330 detecting the size of the sheets P. The sheet size detector 330 includes an encoder sensor 332, a linear scale 331, and a control unit 301.

The encoder sensor 332 is disposed monolithic with the second rail engaging portion 320. The linear scale 331 is disposed monolithic with the hopper 101. Accordingly, it is possible to detect the position of the left guide 308.

Here, the right guide 307 is located at a symmetric position of the left guide 308 by the link mechanism 360. Accordingly, the control unit 301 can necessarily recognize the position of the right guide 307.

The recording apparatus 100 is turned on, the sheets P is set in the hopper 101, the sheet size is detected in accordance with a recording command, and then the recording operation is performed. In detecting the sheet size, the right guide 307 and the left guide 308 widened in the width direction X are first made to move to the center by driving the DC motor 302. Accordingly, the right guide 307 and the left guide 308 come in contact with the right ends and the left ends of the sheets P, respectively.

When the current value of the DC motor 302 is less than a predetermined threshold value, the control unit 301 continues to drive the DC motor 302. When the current value of the DC motor 302 reaches the predetermined threshold value, the control unit 301 stops the driving of the DC motor 302. That is, when the current value is less than the threshold value, both lateral edges of the sheets P are not aligned and it is thus determined that the load is small and the current value is small. On the other hand, when the current value reaches the threshold value, both lateral edges of the sheets P are aligned and it is thus determined that the right guide 307 and the left guide 308 cannot move to the center any more.

Then, the position of the left guide 308 when the current value reaches the threshold value is detected by the encoder sensor 332 and the linear scale 331. Here, the position of the right guide 307 is a symmetric position of the left guide 308 as described above. Accordingly, the sheet size set in the hopper 101 can be detected.

Figure 7:
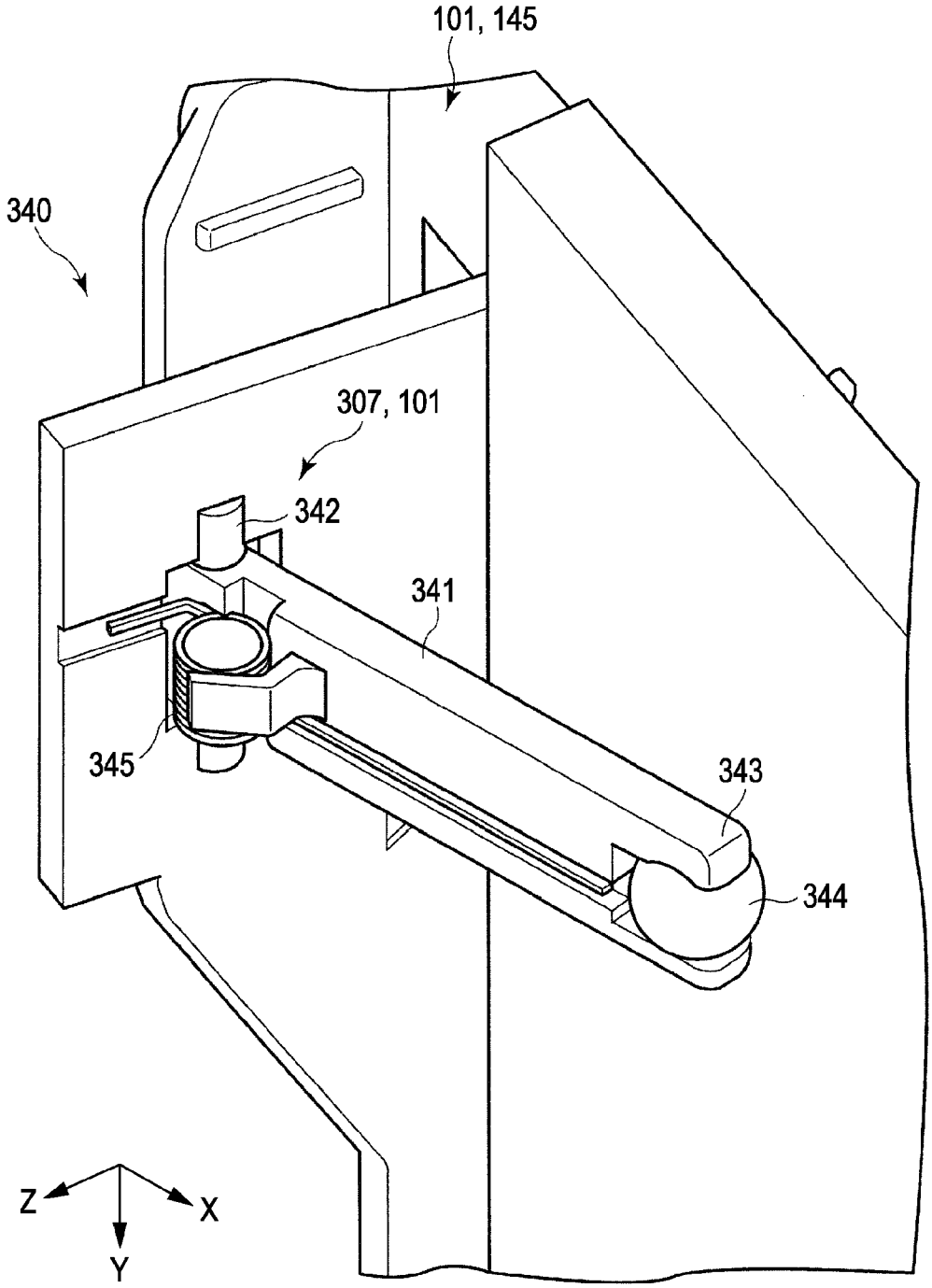
FIG. 7 is an enlarged perspective view illustrating a part of a pressing mechanism according to the embodiment of the invention.

FIG. 7 is an enlarged perspective view illustrating a part of the pressing mechanism according to the embodiment of the invention.

As shown in FIG. 7, the pressing mechanism 340 includes an arm portion 341, a ball portion 344, and a pressing spring 345. The arm portion 341 has an arm shaft 342 at one end and a ball holding portion 343 at the other end. The arm shaft 342 is rotatably held by the right guide 307. The ball holding portion 343 is disposed to rotatably hold the ball portion 344. The arm portion 341 rotates so that the ball portion 344 moves in the stacking direction Z of the sheets P about the arm shaft 342.

The pressing spring 345 urges the arm portion 341 so that the ball portion 344 moves down in the stacking direction.

Accordingly, the pressing mechanism 340 can prevent the stacked sheets P from floating up in the stacking direction. The ball portion 344 held by the ball holding portion 343 is rotatable in any direction. Accordingly, when the right guide 307 is moving in the width direction, the ball portion does not prevent the movement of the right guide 307. That is, it is possible to minimize the increase in load of the DC motor 302.

When the current value reaches the threshold value, that is, when the right guide 307 and the left guide 308 come in pressing contact with the sheets P having both lateral edges aligned, the central portion of the sheets P may be bent to be lifted up in the stacking direction, which is called lifting deformation. In this case, the sheet size may not be detected with high precision.

In this case, the pressing mechanism 340 can prevent the central portion of the sheet P from being bent upward in the stacking direction. That is, it is possible to prevent the lifting deformation of the sheet P.

As a result, it is possible to detect the sheet size with high precision. This configuration is effective particularly when the number of stacked sheets P is relatively small or when the flexibility of the sheets P is small. Even when only one sheet of normal paper is set in the hopper 101, it is possible to detect the sheet size with high precision.

As described above, the ball holding portion 343 is disposed to rotatably hold the ball portion 344. Accordingly, at the time of feeding the sheets P, it is possible to minimize the resistance generated between the sheet P and the pressing mechanism 340.

Although the right guide is described, the same is true in the left guide and thus description thereof is omitted.

Figure 8:
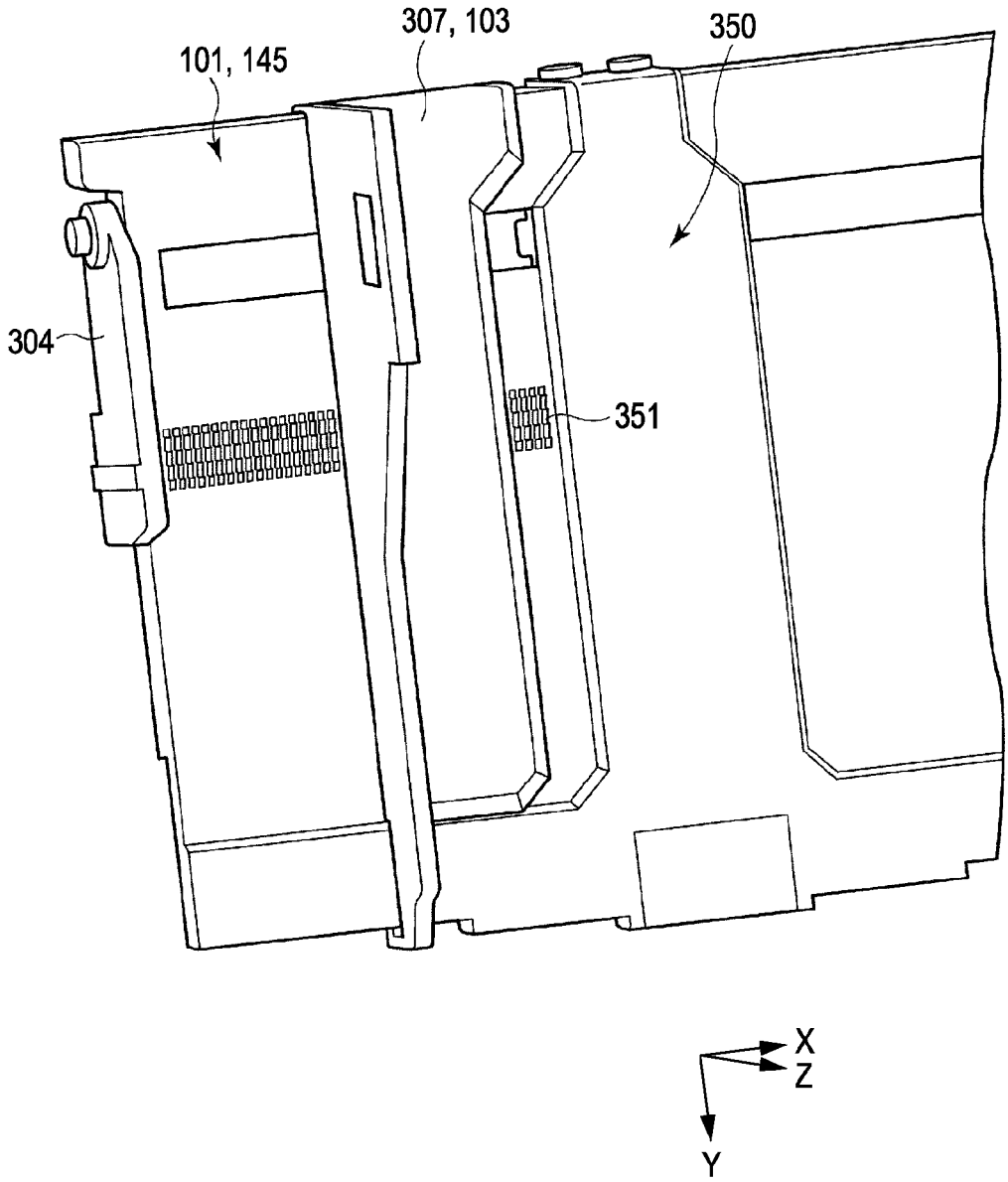
FIG. 8 is a perspective view illustrating a hopper according to the embodiment of the invention.
Figure 9:
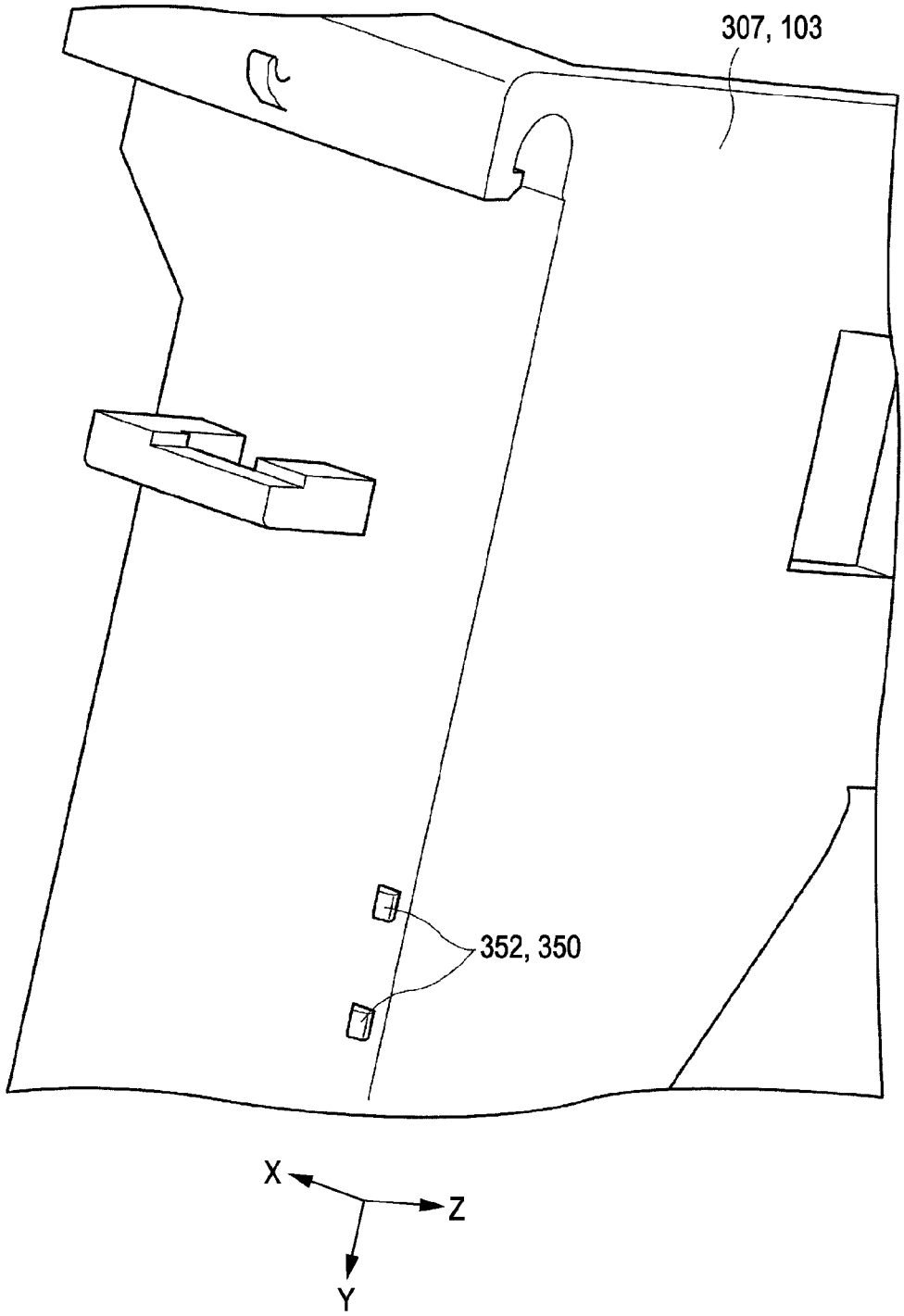
FIG. 9 is a rear enlarged perspective view illustrating an edge guide according to the embodiment of the invention.

FIG. 8 is a perspective view illustrating the hopper according to the embodiment of the invention. FIG. 9 is a rear enlarged perspective view illustrating the edge guide according to the embodiment of the invention.

As shown in FIGS. 8 and 9, the loading section 145 is provided with a vibration generating mechanism 350. The vibration generating mechanism 350 includes an uneven portion 351 disposed on the front surface of the hopper 101 and protruding portions 352 and 352 disposed on the bottom surface of the edge guides 103 and 103. The protruding portions 352 and 352 come in contact with the uneven portion 351. The vibration generating mechanism 350 generates a vibration by allowing the protruding portions 352 and 352 to move while coming in contact with the uneven portion 351.

Accordingly, when the right guide 307 and the left guide 308 move to the center to align both lateral edges of the sheets P, it is possible to allow the sheets P to vibrate by the use of the hopper 101.

Here, it may be difficult to align both lateral edges due to the close attachment of the sheet P and the sheet stacked in the hopper.

Therefore, it is possible to give a vibration to the sheets P by the use of the vibration generating mechanism 350. At this time, the vibration direction is a direction intersecting the surface of the sheet P. Accordingly, it is possible to generate a gap between the sheet P and the sheet P. That is, it is possible to align both lateral edges while undoing a bundle of sheets P. Accordingly, it is possible to easily align both lateral edges of the sheets P. As a result, it is possible to precisely detect the sheet size.

The above description will be described again in detail as follows.

When the vibration in the direction intersecting the surface of the sheet P is generated, it is possible to generate a slight gap between the sheet P and the sheet P by bumping the sheet P and the sheet P overlapping with each other. That is, the lower sheet P in the stacking direction acts to slightly tip up the upper sheet P, thereby generating a slight gap between the sheet P and the sheet P. Accordingly, the sheet P and the sheet P closely attached to each other can be satisfactorily detached.

When the vibration in the direction intersecting the surface of the sheet P is being generated, the upper sheet P and the lower sheet P are repeatedly slightly bumped against each other, thereby continuously generating the slight gap. Due to the slight gap, it is possible to reduce the frictional resistance between the sheet P and the sheet P overlapping with each other. As a result, it is possible to easily align the lateral edges of the sheets P.

Since the sheets P overlapping with each other have a flexible sheet shape, the sheets can be easily bent in the stacking direction Z and can be hardly bent in the width direction X. Accordingly, when the vibration in the stacking direction Z is generated, the sheets P are slightly bent, thereby generating a slight gap between the sheet P and the sheet P overlapping with each other.

Here, when a bundle of new sheets P is set in the hopper 101, the sheet P and the sheet P may be closely attached in the cutting surface of the sheets P. In this case, the bundle of sheets P can be undone by generating the vibration. Accordingly, it is possible to easily pick up the sheets P with the feed roller 190 at the time of feeding the sheets. The bank separation portion 212 and the feed roller 190 can cooperate to easily separate only the uppermost sheet from the second uppermost and lower sheets. That is, it is possible to reduce the possibility that two or more sheets P are feed at a time.

The number of protruding portions 352 is not limited. Although the vibration generating mechanism 350 is disposed in the right guide, it may be disposed in the left guide.

Operations of detecting the sheet size will be described now.

Figure 10:
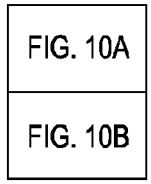
FIGS. 10A and 10B are diagrams illustrating a flow of operations of the edge guide according to the embodiment of the invention.
Figure 10A:
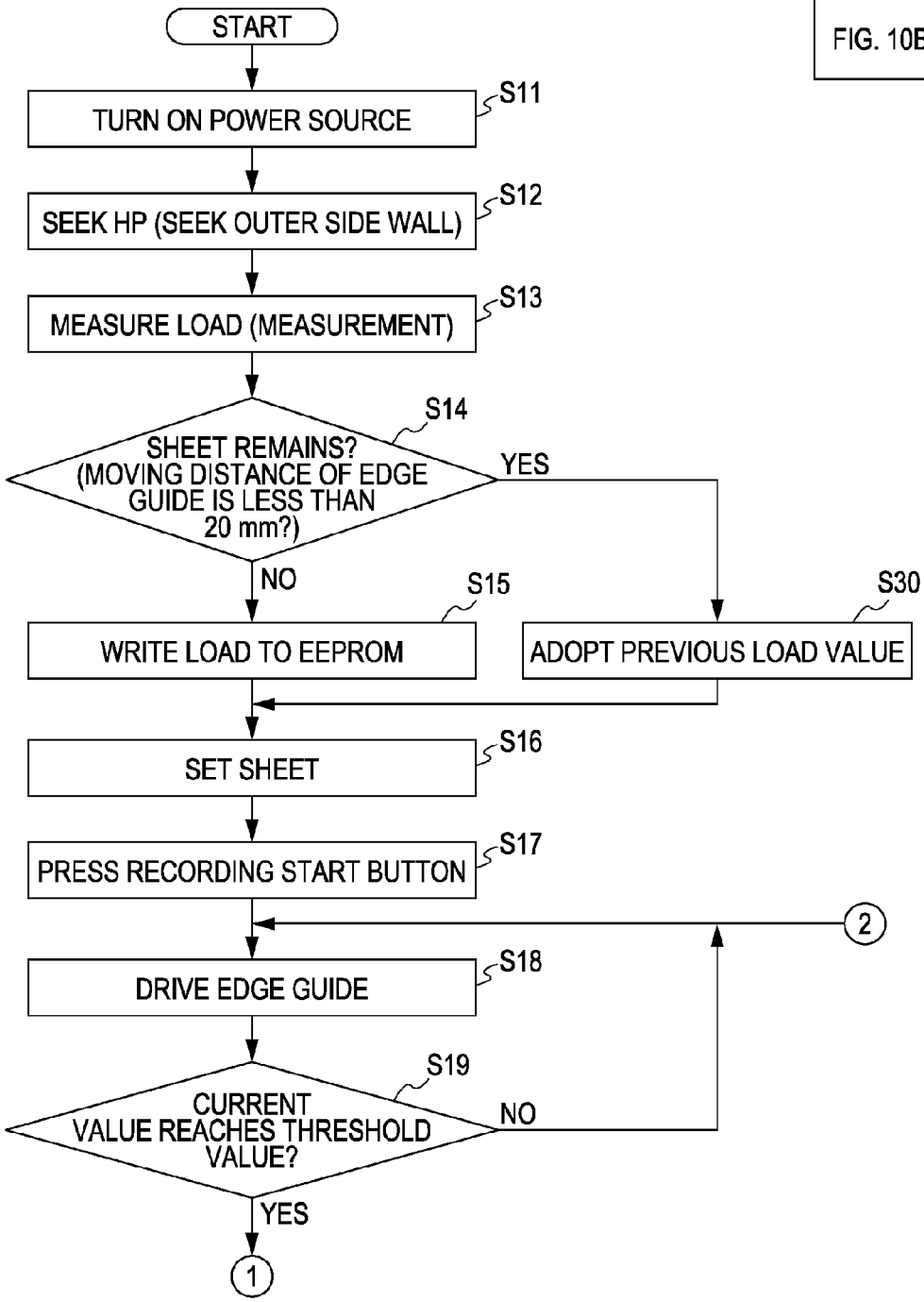
Figure 10B:
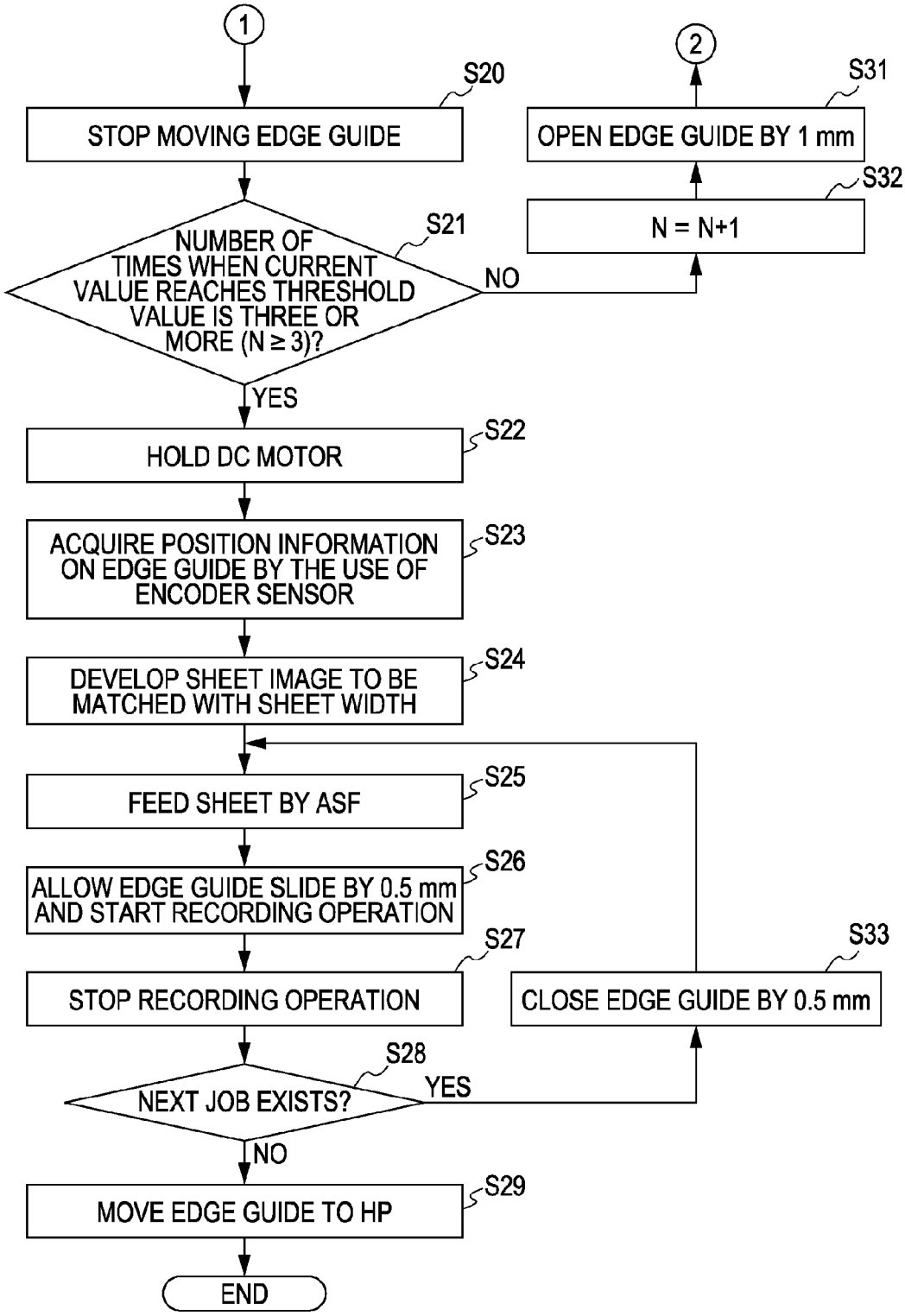

FIGS. 10A and 10B are diagrams illustrating a flow of operations of the edge guides according to the embodiment of the invention.

As shown in FIGS. 10A and 10B, in step 11 (hereinafter, simply referred to as S11), a user turns on the recording apparatus 100. Then, the process of S12 is performed.

In S12, a home position (HP) seeking operation is performed. Specifically, the control unit 301 allows the right guide 307 and the left guide 308 to move to the home position (position shown in FIGS. 5 and 6) which is the outermost position in the movable range in the width direction X. Then, the process of S13 is performed.

In S13, a so-called measurement process of measuring a load is performed. Specifically, the control unit 301 measures the current value of the DC motor 302 as a load when the right guide 307 and the left guide 308 move. At this time, the right guide 307 and the left guide 308 move to the innermost position in the movable range from the home position and then move to the home position.

Here, by the measurement, the "predetermined threshold value" to be described later can be changed.

Then, the process of S14 is performed.

In S14, it is determined whether a sheet P remains in the hopper. This is to confirm whether the measurement of load performed in S13 is normally finished. Specifically, in the measurement of load performed in S13, it is determined whether the moving distance of the right guide 307 and the left guide 308 is less than 20 mm.

Here, the distance of "20 mm" is a distance slightly greater than the distance from the home position to a position to which the minimum size of predetermined sheet sizes is guided. Accordingly, when the moving distance is less than 20 mm, it means that a sheet P of any size remains in the hopper. On the other hand, when the moving distance is 20 mm or more, it means that a sheet P does not remain in the hopper.

When the moving distance is less than 20 mm, the process of S15 is performed. On the other hand, when the moving distance is 20 mm or more, the process of S30 is performed.

In S15, the load value normally measured in the measurement of load in S13 is written to an EEPROM of the control unit 301. Then, the process of S16 is performed.

In S16, a user sets sheets P in the hopper. Then, the process of S17 is performed.

In S17, a recording start button is pressed. That is, a command for starting a recording operation is given to the recording apparatus 100. Here, the command for starting the recording operation is not limited to the actual operation of button. Then, the process of S18 is performed.

In S18, the edge guides 103 and 103 are driven. Specifically, the control unit 301 drives the DC motor 302 and allow the right guide 307 and the left guide 308 to move to the center from the home position. At this time, as described above, it is possible to align both lateral edges of the sheets P while undoing the bundle of sheets P by the use of the vibration generating mechanism 350.

Then, the process of S19 is performed.

In S19, the determination unit 300 of the control unit 301 determines whether the current value of the DC motor 302 reaches a predetermined threshold value.

Here, the "predetermined threshold value" is a value greater than the current value resulting from the load when the right guide 307 and the left guide 308 come in contact with one lateral edge of the sheets P. The predetermined threshold value is also a value smaller than the current value resulting from the load when the right guide 307 and the left guide 308 come in contact with both lateral edges of the sheets P of which both lateral edges are aligned.

Accordingly, when the current value reaches the predetermined threshold value, this state can be determined as a state where both lateral edges of the sheets P are aligned. On the other hand, when the current value does not reach the predetermined threshold value, this state can be determined as a state before the right guide 307 and the left guide 308 come in contact with both lateral edges of the sheets P or a state where both lateral edges of the stacked sheets P are not aligned.

When the current value reaches the predetermined threshold value, the process of S20 is performed. On the other hand, when the current value does not reach the predetermined threshold value, the DC motor 302 is continuously driven in S18.

In S20, the edge guides 103 and 103 are stopped. Specifically, the control unit 301 stops the driving of the DC motor 302 to stop the movement of the right guide 307 and the left guide 308. Then, the process of S21 is performed.

In S21, it is determined whether the number of times when the current value reaches the threshold value is three or more. When the number of times is three or more, the process of S22 is performed. When the number of times is less than three, the process of S32 is performed.

In S22, the DC motor 302 is held. Specifically, the motor pinion 303 is made not to rotate by supplying small current to the DC motor 302.

Here, when no current is supplied, the motor pinion 303 may rotate with an external force receiving through the edge guides 103 and 103 and the link mechanism 360. That is, the positions of the right guide 307 and the left guide 308 may move. In this case, the posture of the sheets P of which both lateral edges are aligned may be unstable. The lateral edges of the sheets P may not be uniform.

Therefore, by holding the DC motor 302, the posture of the sheets P and the state where both lateral edges of the sheets P are aligned can be maintained. Then, the process of S23 is performed.

In S32, the position information on the edge guides 103 and 103 is acquired by the encoder sensor 332. Specifically, the control unit 301 acquires the position information on the left guide 308 by the use of the encoder sensor 332 and the linear scale 331. At this time, as described above, the position of the right guide 307 becomes a symmetric position of the left guide 308 by the link mechanism 360. That is, when the position information on the left guide 308 is acquired, the position of the right guide 307 can be acquired. Accordingly, the control unit 301 can detect which sheet size of the sheets P set in the hopper is out of predetermined sheet sizes with high precision. Here, when the sheet size acquired from the position information on the edge guides 103 and 103 is greatly different from the predetermined sheet size, an error or an alarm can be displayed. When the difference in sheet size is small, the size of the sheets P set in the hopper can be estimated as the predetermined sheet size. Then, the process of S24 is performed.

In S24, a sheet image is developed to be matched with the sheet width. Specifically, the control unit 301 adjusts the size reflecting the recording range in recording data on the basis of the acquired information on the sheet size.

Here, the size reflecting the range may be adjusted on the basis of the estimated sheet size.

Then, the process of S25 is performed.

In S25, a sheet is fed by the use of an automatic sheet feeder (ASF) as the feeding section 144. Specifically, as described above, the hopper moves up and the rotation of the feed roller 190 is started. The uppermost sheet P of the sheets P set in the hopper 101 is sent downstream in the feeding direction. Then, the process of S26 is performed.

In S26, the edge guides 103 and 103 are made to move outward in the width direction X by 0.5 mm to start the recording operation. Specifically, after the leading end of the fed sheet P is nipped by the transport roller pair 220, the control unit 301 drives the DC motor 302 to allow the right guide 307 and the left guide 308 to move outward by 0.5 mm. Accordingly, a slight gap is generated between both lateral edges of the sheet P and the right guide 307 and the left guide 308. That is, frictional resistance is not generated between the right guide 307 and the left guide 308 and both lateral edges of the sheet P. The fed sheet p is satisfactorily nipped by the transport roller pair 220. Accordingly, even when the right guide 307 and the left guide 308 are apart from the lateral edges of the sheet P, the posture of the fed sheet P is not unstable.

Thereafter, the recording operation using the recording head 106 is started while transporting the sheet P by the use of the transport roller pair 220. Accordingly, it is possible to minimize the back tension in the course of performing the recording operation. Then, the process of S27 is performed.

In S27, the recording operation is ended and the sheet P is discharged. Then, the process of S28 is performed.

In S28, it is determined whether a next job remains. Specifically, the control unit 301 determines whether a recording command as the next job is given. When the next job does not remain, the process of S29 is performed. On the other hand, when the next job remains, the process of S33 is performed.

In S29, the edge guides 103 and 103 are made to move to the home position. Specifically, the control unit 301 drives the DC motor 302 to allow the right guide 307 and the left guide 308 to move to the home position. Accordingly, sheets P having a different size may be reset in the hopper to change the size of the sheets P as needed. At this time, the right guide 307 and the left guide 308 are located at the outermost within the movable range in the width direction X. Accordingly, a sheet P having any settable sheet size can be set.

In S30, the previous load value is adopted. Specifically, since any sheet P remains in the hopper, the present measurement of load is not performed normally. Accordingly, the previous load value is used instead. Then, the process of S16 is performed.

In S31, the edge guides 103 and 103 are made to move outward by 1 mm. Specifically, the control unit 301 drives the DC motor 302 to allow the right guide 307 and the left guide 308 to move outward in the width direction by 1 mm. That is, the right guide 307 and the left guide 308 are apart from both lateral edges of the sheets P. Then, the process of S18 is performed.

In S32, N=N+1 is set. Specifically, the number of times when the current value reaches the threshold value is increased. Then, the process of S31 is performed.

By performing the loop of S18 to S21, S32, and S31 three times, the edge guides 103 and 103 can be bumped against both lateral edges of the sheets P three times at the time of aligning both lateral edges of the sheets P. Accordingly, compared with the case where the number of bumping times is only one, it is possible to align both lateral edges of the sheets P with higher precision.

That is, only once bumping may not be sufficient and thus it is possible to satisfactorily align both lateral edges of the sheets P by the plural times of bumping. This is effective particularly when a frictional coefficient between the sheet P and the sheet P overlapping with each other is relatively high and it is difficult to align both lateral edges of the sheets P.

By the plural times of bumping, it is possible to generate a gap between the sheet P and the sheet P. Accordingly, it is possible to align both lateral edges while undoing the bundle of stacked sheets P. That is, it is possible to undo the sheet P and the sheet P closely attached to each other and to align both lateral edges of the sheets with high precision.

In S21, the number of times can be set to a natural number other than 3. Specifically, the number of times can be set to a natural number of 2 or 4 or more.

In this embodiment, the edge guides 103 and 103 are of a center alignment type where the right guide 307 and the left guide 308 move symmetrically, but are not limited to the center alignment type. That is, the edge guides 103 and 103 may be of a one-sided type where one is fixed and the other is movable.

The recording apparatus 100 according to this embodiment includes the hopper 101 as the loading section 145 in which sheets P as an example of the recording mediums are set; the feed roller 190 feeding the sheets set in the hopper 101; the hopper lever 280 and the torsion coil spring 290 as the first urging mechanism urging one of the hopper 101 and the feed roller 190 to decrease a distance between the set sheets P and the feed roller 190; the right guide 307 and the left guide 308 as the edge guides being movable in the width direction X of the sheets P to align the lateral edges of the sheets P set in the hopper 101; the DC motor 302 allowing the right guide 307 and the left guide 308 to move; the determination unit 300 determining whether the current value at the time of driving the DC motor 302 reaches a predetermined threshold value; and the recording section 143 performing a recording operation on the fed sheet P by the use of the recording head 106, and stops the driving of the DC motor 302 when it is determined by the determination unit 300 that the current value reaches the predetermined threshold value.

The recording apparatus 100 according to this embodiment further includes the sheet size detector 330 as the medium size detector including: the linear scale 331 disposed in one of the hopper 101 and the edge guides 103 and 103; and the sensor 332 disposed in the other thereof to detect the linear scale 331.

The recording apparatus 100 according to this embodiment further includes the vibration generating mechanism 350 generating a vibration in the hopper 101 when the right guide 307 and the left guide 308 as the edge guides 103 and 103 move.

In this embodiment, the vibration generating mechanism 350 generates a vibration in the stacking direction Z of the sheets P intersecting the width direction X and the feeding direction Y.

In this embodiment, the vibration generating mechanism 350 includes the uneven portion 351 as the first uneven portion disposed in one of the hopper 101 and the edge guides 103 and 103 to have an uneven shape in the width direction X and the protruding portions 352 and 352 as the first convex portion disposed in the other thereof to come in contact with the uneven portion 351.

In this embodiment, the DC motor 302 is driven to allow the edge guides 103 and 103 to move close to the lateral edges of the sheets P (S18), the driving of the DC motor 302 is stopped (S20) when the current value reaches the predetermined threshold value (S19), and the backward (S31) and forward (S18) rotations of the DC motor 302 are repeated to bump the edge guides 103 and 103 against the lateral edges of the sheets P several times (S18 to S21, S32, and S31).

In the recording apparatus 100 according to this embodiment, the right guide 307 and the left guide 308 as the edge guides 103 and 103 include: the arm portion 341 being movable in the stacking direction or thickness direction Z of the set sheets P; the ball portion 344 as the spherical portion rotatably disposed at an end of the arm portion 341; and the pressing spring 345 as the second urging mechanism urging the arm portion 341 to the sheets.

Other Embodiments

Figure 11:
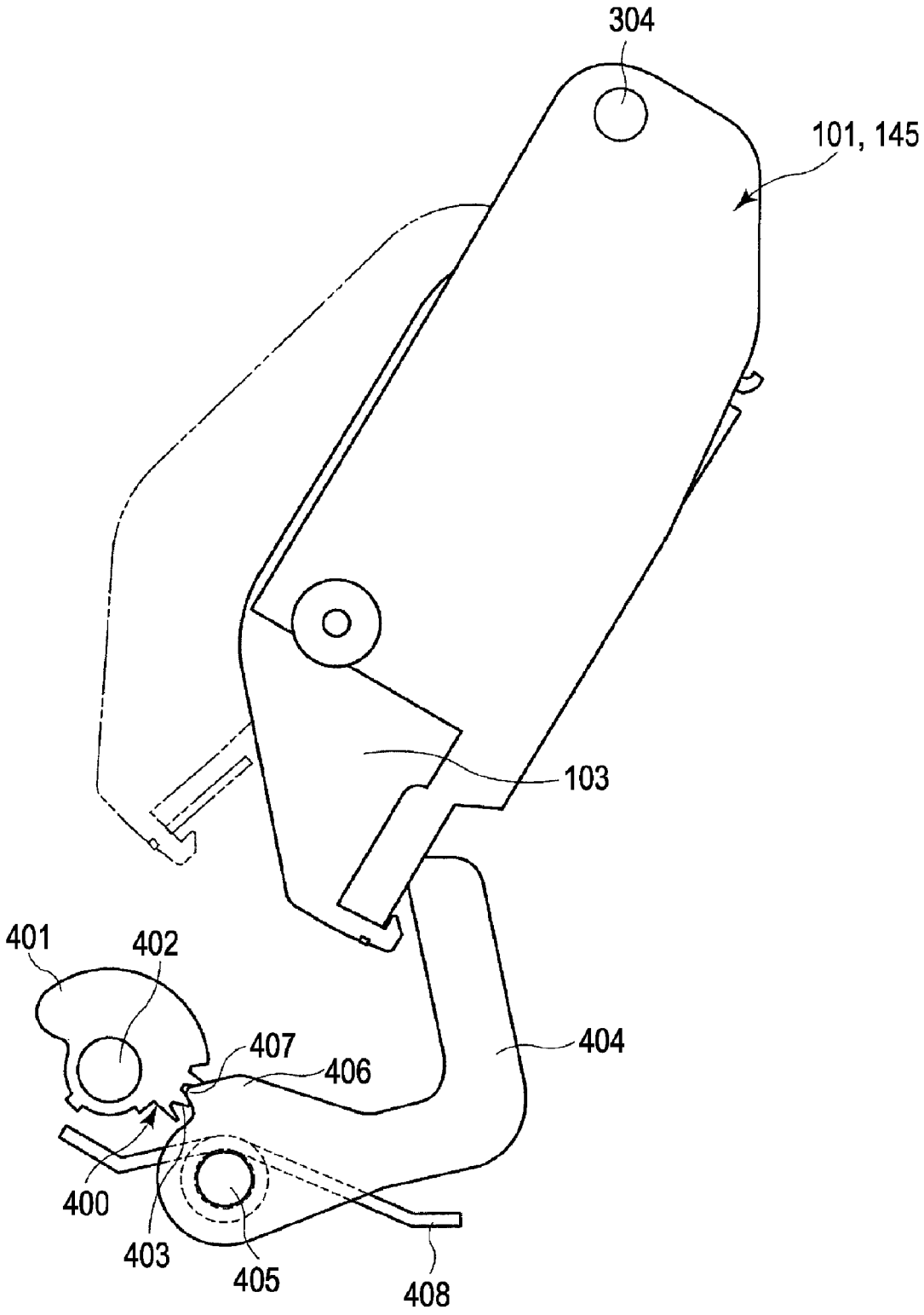
FIG. 11 is a side view illustrating a loading section according to another embodiment of the invention.

FIG. 11 is a side view illustrating a loading section according to another embodiment of the invention.

As shown in FIG. 11, a cam portion 401 is disposed to be rotatable about a camp shaft 402. A hopper lever 404 is disposed to be rotatable about a lever shaft 405. The hopper lever 404 is urged counterclockwise in the drawing by a hopper spring 408. The hopper lever 404 is provided with a cam follower 406 engaging with the cam portion 401.

Similarly to the above-mentioned embodiment, by allowing the cam portion 401 to rotate, it is possible to allow the hopper lever 404 to fluctuate. Specifically, by allowing the cam portion 401 to engage with the cam follower 406, the hopper-down state can be obtained. When the cam portion 401 is disengaged from the cam follower 406, the hopper-up state can be obtained with the urging force of the hopper spring 408.

The loading section 145 according to another embodiment includes a vibration generating mechanism 400. The vibration generating mechanism 400 includes an uneven portion 403 and an angled portion 407. The uneven portion 403 is formed in the cam portion 401. The angled portion 407 is formed in the cam follower 406.

Since the other members are similar to those of the above-mentioned embodiment, the same reference numerals and signs are used and thus description thereof is omitted.

Operations of the vibration generating mechanism 400 will be described now.

Figure 12A:
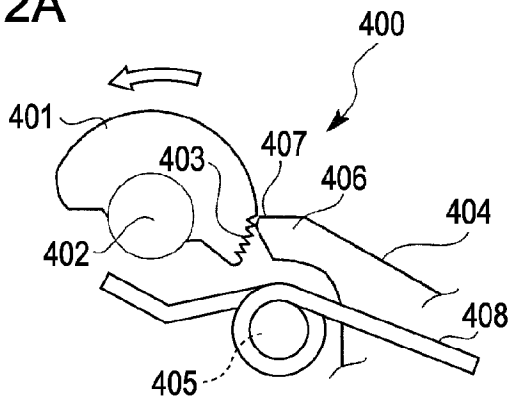
FIGS. 12A to 12D are side views schematically illustrating operations of a vibration generating mechanism.
Figure 12B:
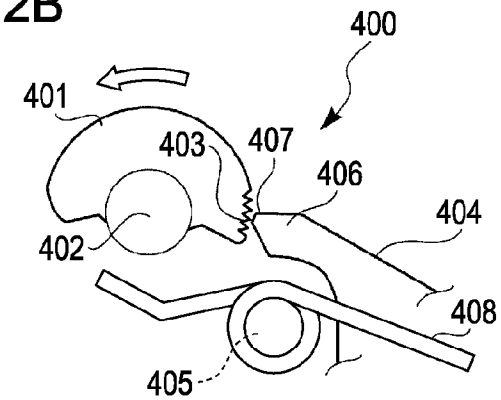
Figure 12C:
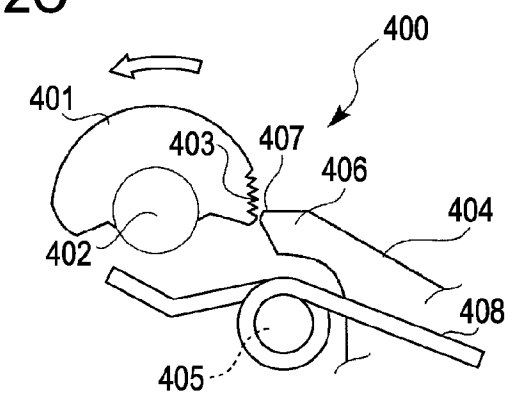
Figure 12D:
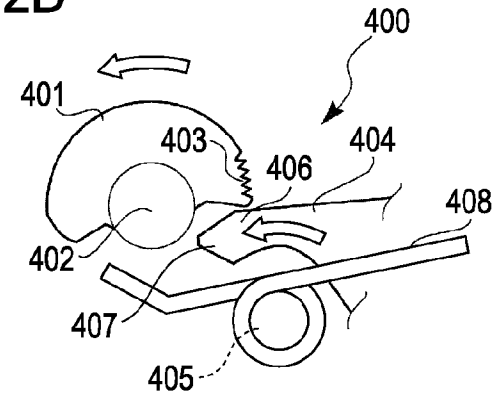

FIGS. 12A to 12B are side views schematically illustrating operations of the vibration generating mechanism. FIGS. 12A to 12C show the hopper-down state just before the hopper-up state. FIG. 12D shows the hopper-up state.

As shown in FIG. 12A, the hopper 101 before the feeding is in the hopper-down state. At the time of S18 in the above-mentioned embodiment, the cam portion 401 is made to rotate counterclockwise. Accordingly, the angled portion 407 engages with the uneven portion 403 to generate a vibration.

At this time, it is possible to transmit the vibration to the hopper 101 through the hopper lever 404.

As shown in FIGS. 12B and 12C, when the cam portion 401 rotates counterclockwise again from the state shown in FIG. 12A, the vibration can be continuously generated. Accordingly, when the loop of S18 to S21, S32, and S31 in the above-mentioned embodiment is being repeated, the vibration can be continuously generated. As a result, similarly to the above-mentioned embodiment, a gap is generated between the sheet P and the sheet P, thereby undoing the bundle of stacked sheets P. It is possible to align both lateral edges of the sheets P with high precision, thereby detecting the sheet size with high precision.

As shown in FIG. 12D, when the cam portion 401 rotates counterclockwise again from the state shown in FIG. 12C, the engagement of the cam portion 401 and the cam follower 406 is released to obtain the hopper-up state.

Here, the hopper-up time is the time of S25 in the above-mentioned embodiment.

The rotating member (not shown) of a suction pump of the ink suction device 200 (see FIG. 1) as the vibration generating mechanism may be made to be eccentric to generate the vibration.

When the loop of S18 to S21, S32, and S31 in the above-mentioned embodiment is being repeated, the hopper 101 may be made to move from the hopper-down state in the direction in which it is apart from the feed roller 190. That is, a new hopper-down operation can be embodied. In this case, similarly to the above-mentioned vibration generating mechanism, a gap is generated between the sheet P and the sheet P, thereby undoing the bundle of sheets P.

In another embodiment, the recording apparatus 100 includes the hopper lever 404 urging the hopper 101 as the loading section 145 in the direction in which it is close to the feed roller 190 and a cam portion 401 allowing the hopper lever 404 to fluctuate.

The vibration generating mechanism 400 includes the uneven portion 403 as the second uneven portion disposed in one of the hopper lever 404 and the cam portion 401 to have an uneven shape in a rotation direction of the cam portion 401 and the angled portion 407 as the second convex portion disposed in the other thereof to come in contact with the uneven portion 403, and brings the uneven portion 403 and the angled portion 407 into contact with each other in a state where the set sheets P and the feed roller 190 are separated from each other.

In another embodiment, the vibration generating mechanism is an ink suction device 200 (see FIG. 1) cleaning the recording head 106 disposed in the recording section 143 by suction.

In the recording apparatus 100 according to another embodiment, the hopper 101 is made to move further apart from the feed roller 190 when the right guide 307 and the left guide 308 as the edge guides 103 and 103 move in a state where the set sheets P and the feed roller 190 are separated from each other.

The invention is not limited to the above-mentioned embodiments, but may be modified in various forms without departing from the scope of the invention described in the appended claims. Of course, the modifications are included in the scope of the invention.

What is claimed is:

1. A recording apparatus comprising:

a loading section in which a recording medium is configured to be set;

a feed roller for feeding the recording medium set in the loading section;

a first urging mechanism for urging one of the loading section and the feed roller to decrease a distance between the set recording medium and the feed roller;

an edge guide being movable in a width direction of the recording medium to align lateral edges of the recording medium set in the loading section;

a DC motor for allowing the edge guide to move; and a determination unit configured to determine whether a current value at the time of driving the DC motor reaches a predetermined threshold value, wherein the driving of the DC motor is configured to be stopped when it is determined by the determination unit that the current value reaches the predetermined threshold value, wherein the DC motor is configured to be driven to allow the edge guide to move close to the lateral edge of the recording medium, the driving of the DC motor is configured to be stopped when the current value reaches the predetermined threshold value, and backward and forward rotations of the DC motor are configured to be repeated to bump the edge guide against the lateral edge of the recording medium several times.

2. The recording apparatus according to claim 1, further comprising a vibration generating mechanism causing the loading section to vibrate when the edge guide moves.

3. The recording apparatus according to claim 2, wherein the vibration generating mechanism generates a vibration in a stacking direction of the recording medium.

4. The recording apparatus according to claim 2, wherein the vibration generating mechanism includes:

a first uneven portion disposed in one of the loading section and the edge guide to have an uneven shape in the width direction; and a first convex portion disposed in the other to come in contact with the first uneven portion.

5. The recording apparatus according to claim 2, further comprising:

a hopper lever urging the loading section to the feed roller; and a cam portion allowing the hopper lever to fluctuate, wherein the vibration generating mechanism includes:

a second uneven portion disposed in one of the hopper lever and the cam portion to have an uneven shape in a rotation direction of the cam portion; and a second convex portion disposed in the other thereof to come in contact with the second uneven portion, and wherein the second uneven portion and the second convex portion are brought into contact with each other in a state where the set recording medium and the feed roller are separated from each other.

6. The recording apparatus according to claim 1, wherein the loading section is made to move further apart from the feed roller when the edge guide moves in a state where the set recording medium and the feed roller are separated from each other.

7. A recording apparatus comprising:

a loading section in which a recording medium is configured to be set;

a feed roller for feeding the recording medium set in the loading section;

a first urging mechanism for urging one of the loading section and the feed roller to decrease a distance between the set recording medium and the feed roller;

an edge guide being movable in a width direction of the recording medium to align lateral edges of the recording medium set in the loading section;

a DC motor for allowing the edge guide to move;

a vibration generating mechanism configured to cause the loading section to vibrate when the edge guide moves; and a determination unit configured to determine whether a current value at the time of driving the DC motor reaches a predetermined threshold value, wherein the driving of the DC motor is configured to be stopped when it is determined by the determination unit that the current value reaches the predetermined threshold value;

a hopper lever for urging the loading section to the feed roller; and a cam portion for allowing the hopper lever to fluctuate, wherein the vibration generating mechanism includes:

a second uneven portion disposed in one of the hopper lever and the cam portion to have an uneven shape in a rotation direction of the cam portion; and a second convex portion disposed in the other thereof to come in contact with the second uneven portion, and wherein the second uneven portion and the second convex portion are brought into contact with each other in a state where the set recording medium and the feed roller are separated from each other.

* * * * *